US006129432A

United States Patent [19]

Pollard

[11] Patent Number: 6,129,432

[45] **Date of Patent: *Oct. 10, 2000**

[54] MULTIPLE CHEST OF DRAWERS HAVING INVERTIBLE CAPABILITIES

[75] Inventor: Patrick Lee Pollard, Columbus, Ga.

[73] Assignee: Baby's Dream Furniture, Inc., Buena Vista, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,098

[22] Filed: Aug. 19, 1997

[51] Int. Cl.[7] ..... A47B 88/00

[52] U.S. Cl. ..... 312/330.1; 312/350

[58] Field of Search ..... 312/330.1, 350, 312/351, 351.7, 334.7, 334.12, 334.21, 334.18, 240, 243, 107; 108/11, 13

[56] References Cited

U.S. PATENT DOCUMENTS

| | | | |
|---|---|---|---|
| 879,233 | 2/1908 | Zimmerli | 312/334.12 |
| 1,127,139 | 2/1915 | West | 312/330.1 X |
| 1,523,653 | 1/1925 | Larson et al. | 312/350 X |
| 2,564,338 | 8/1951 | McCarroll | 108/11 X |
| 2,594,571 | 4/1952 | Lundberg | 312/350 X |
| 3,298,768 | 1/1967 | Vogt | 312/334.12 |
| 3,606,506 | 9/1971 | Ungaro | 312/107 X |
| 3,716,284 | 2/1973 | Vogt | 312/350 X |
| 3,759,191 | 9/1973 | Freeman | 108/42 |
| 4,391,454 | 7/1983 | Marsh et al. . | |
| 4,666,221 | 5/1987 | Ernst | 312/334.18 |
| 5,243,736 | 9/1993 | Cannaday et al. | 312/330.1 X |
| 5,383,721 | 1/1995 | Thomas | 312/7.2 |

*Primary Examiner*—Peter M. Cuomo
*Assistant Examiner*—James O. Hansen
*Attorney, Agent, or Firm*—Jones & Askew LLP

[57] ABSTRACT

Furniture such as chest of drawers including reversible drawers thereinwhich include roller-type drawer brackets but also provides reversible features which allow for the selective use of a chest of drawers which can be used with its "smooth" side up, or with a "changing table"—type top facing upwardly for use.

5 Claims, 7 Drawing Sheets

(FRONT VIEW)

MULTIPLE CHEST OF DRAWERS HAVING INVERTIBLE CAPABILITIES

TECHNICAL FIELD

The invention generally relates to furniture, and particularly relates to chests of drawers having an "invertible" characteristic, in that it can be inverted from one configuration to another, to provide different functions for each orientation.

BACKGROUND OF THE INVENTION

Furniture such as chests of drawers are known, including chests of drawers which include reversible drawers therein. However, to the knowledge of the applicant a need still exists for a chest of drawers which includes roller-type drawer brackets but also provides reversible features which allow for the selective use of a chest of drawers which can be used with its "smooth" side up, or with a "changing table" type top facing upwardly for use.

Therefore there is a need in the art for reversible chest of drawers with roller-type brackets that provide improved wear and use characteristics compared to friction channel configurations and which do not allow for inadvertent withdrawal.

SUMMARY OF THE INVENTION

The present invention overcomes deficiencies in the prior art by providing a reversible drawer configuration which is configured to be used with dual-roller bracket configurations.

Therefore, it is an object of the present invention to provide an improved article of furniture.

It is a further object of the present invention to provide an improved article of furniture which is capable of performing different functions.

It is a further object of the present invention to provide an improved article of furniture which is cost-effective to manufacture.

It is a further object of the present invention to provide an improved article of furniture which is easy to convert between different configurations.

It is a further object of the present invention to provide an improved chest of drawers.

It is a further object of the present invention to provide an improved chest of drawers which is easy to convert between different configurations.

It is a further object of the present invention to provide a chest of drawers which can be converted from a "smooth-top" to a "changing table" top.

Other objects, features; and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

General Configuration and Operation

Generally described, the present invention relates to the use of "invertible" drawer members, which may itself be positioned within a chest of drawers body which may be inverted from two different orientations. The first of these two orientations is referenced in this application as an "upright" orientation, and the second orientation is referenced in this application as an "inverted" orientation. However, it should be understood that such orientation descriptions are only for purposes of discussion, and should not be construed as limiting. For example, the "inverted" configuration could be the most preferred orientation for the end user, and in fact would be possibly considered as the end user as the more conventional or "normal" configuration. Therefore, the term "upright" should not be construed as limiting, but for purposes of discussion only.

Figure 2:
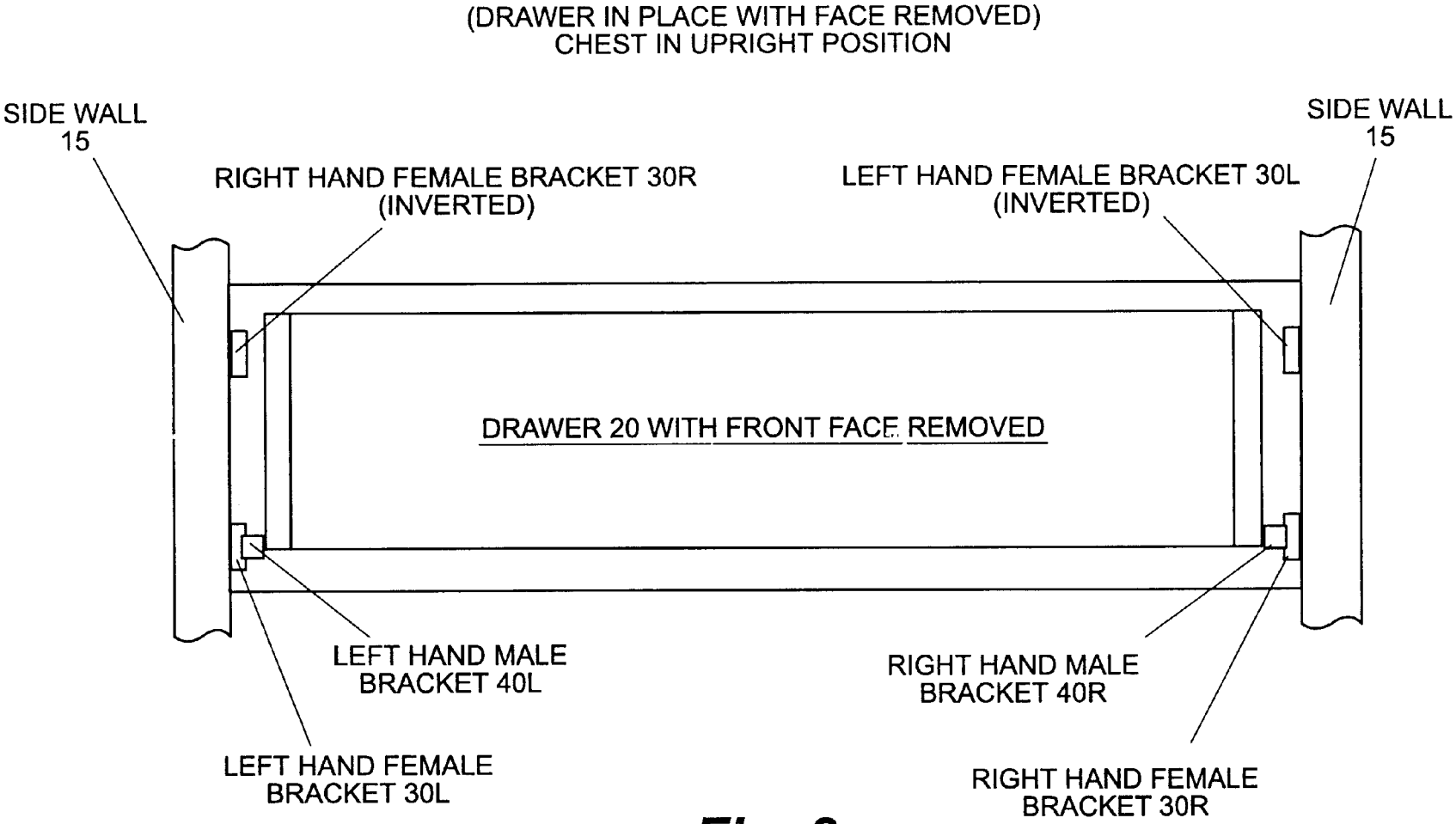
FIG. 2 is an isolated view of a drawer (with its face removed), positioned within a cavity defined by the chest of drawers body 12 of FIG. 1. In this figure, the chest of drawers body 12 is shown in its upright position.

Referring now to FIG. 2, the use of two male brackets 40R, 40L, on each drawer and two sets of female brackets, two each of 30L and 30R, facilitate the inversion of the drawer assemblies 20 while still retaining the convenience and reliability of roller-type bracketry, which in and of itself is known in the art.

Figure 3:
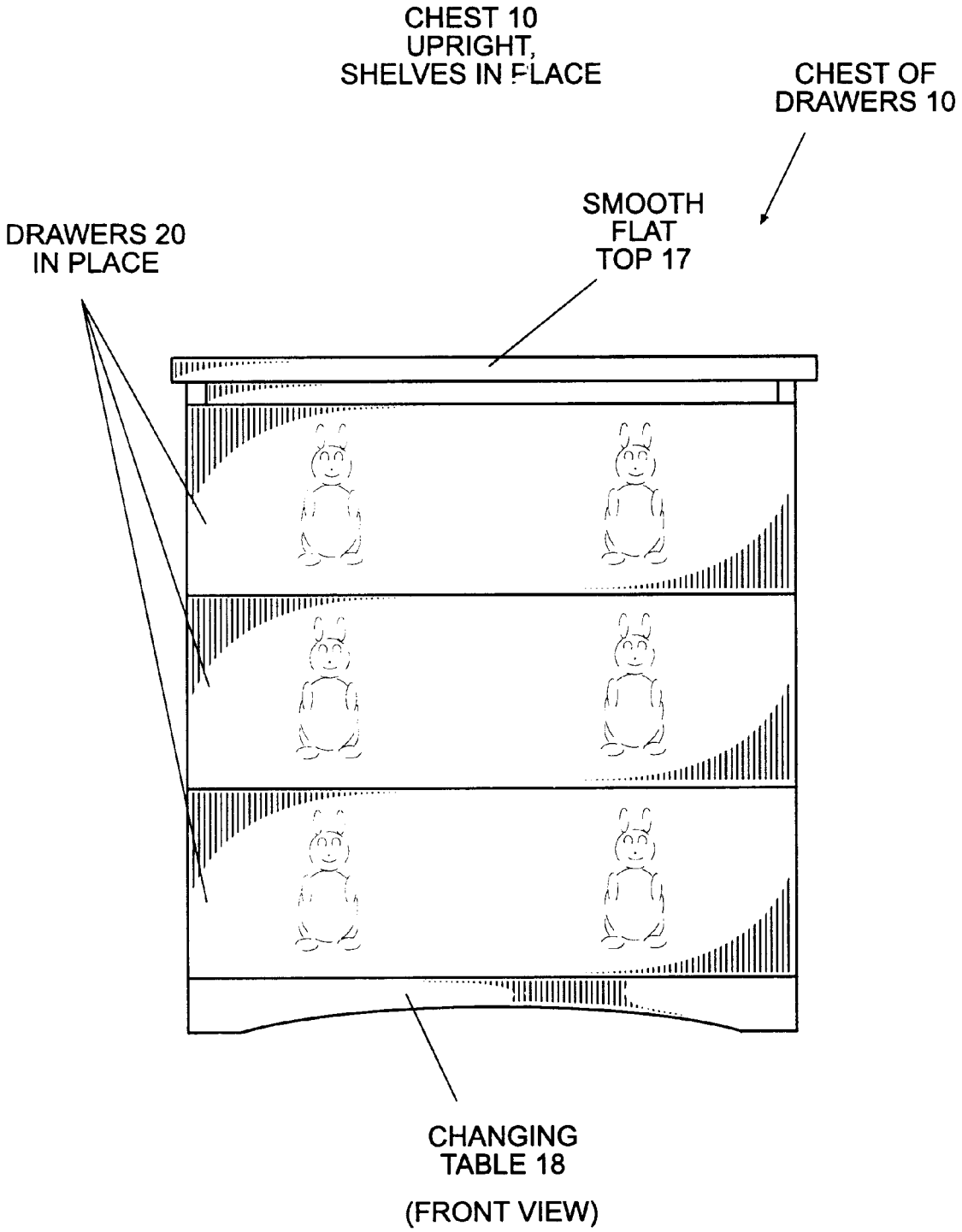
FIG. 3 is an upright chest of drawers 10 according to the present invention, shown with the drawers 20 (a.k.a drawer assemblies 20) in their upright position, and the assembly 10 oriented such that the flat top of the chest of drawers body 12 is directed upwardly.

FIG. 3 illustrates a completed chest of drawers assembly 10 according to the present invention in its "upright" position. As may be seen, the drawer assemblies 20 (which include the male brackets) are in their "upright" configuration, located within the chest of drawers body 12 (see FIG. 1), which is likewise in its "upright" configuration.

Figure 4:
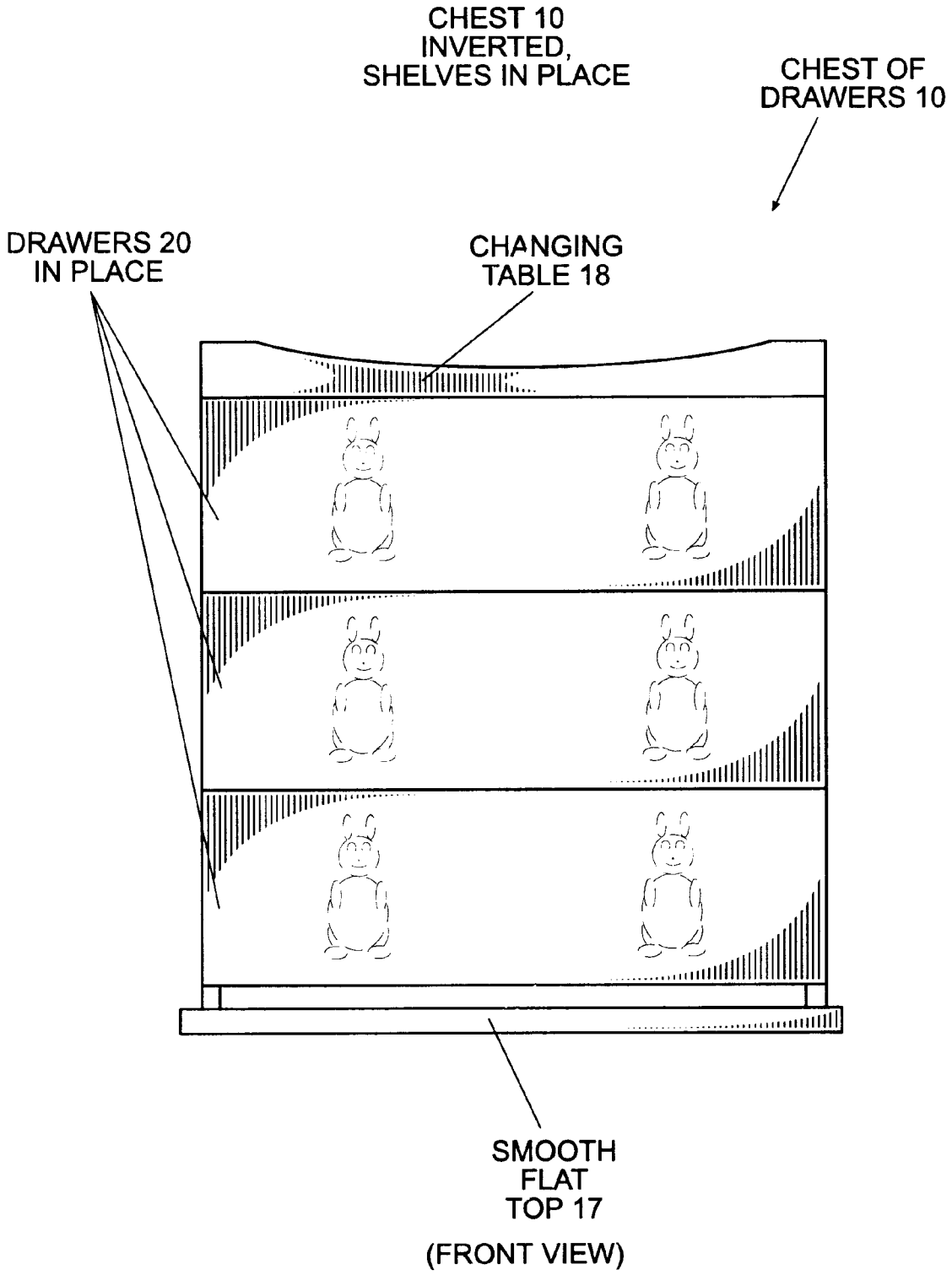
FIG. 4 is a view of the chest of drawers 10 according to the present invention in its "inverted" position, such that its "changing table" side is facing upwardly, and its "flat top" is facing downwardly.

FIG. 4 illustrates a completed chest of drawers assembly 10 according to the present invention in its "inverted" configuration. As may be seen, the drawer assemblies 20 (which include the male brackets) are in their "upright" configuration, located within the chest of drawers body, which is now in its "inverted" configuration. This is because the drawers have been removed and inverted to allow them to be replaced within the respective cavities after the chest of drawers body 12 has been inverted.

The Chest of Drawers Body 12

Figure 1:
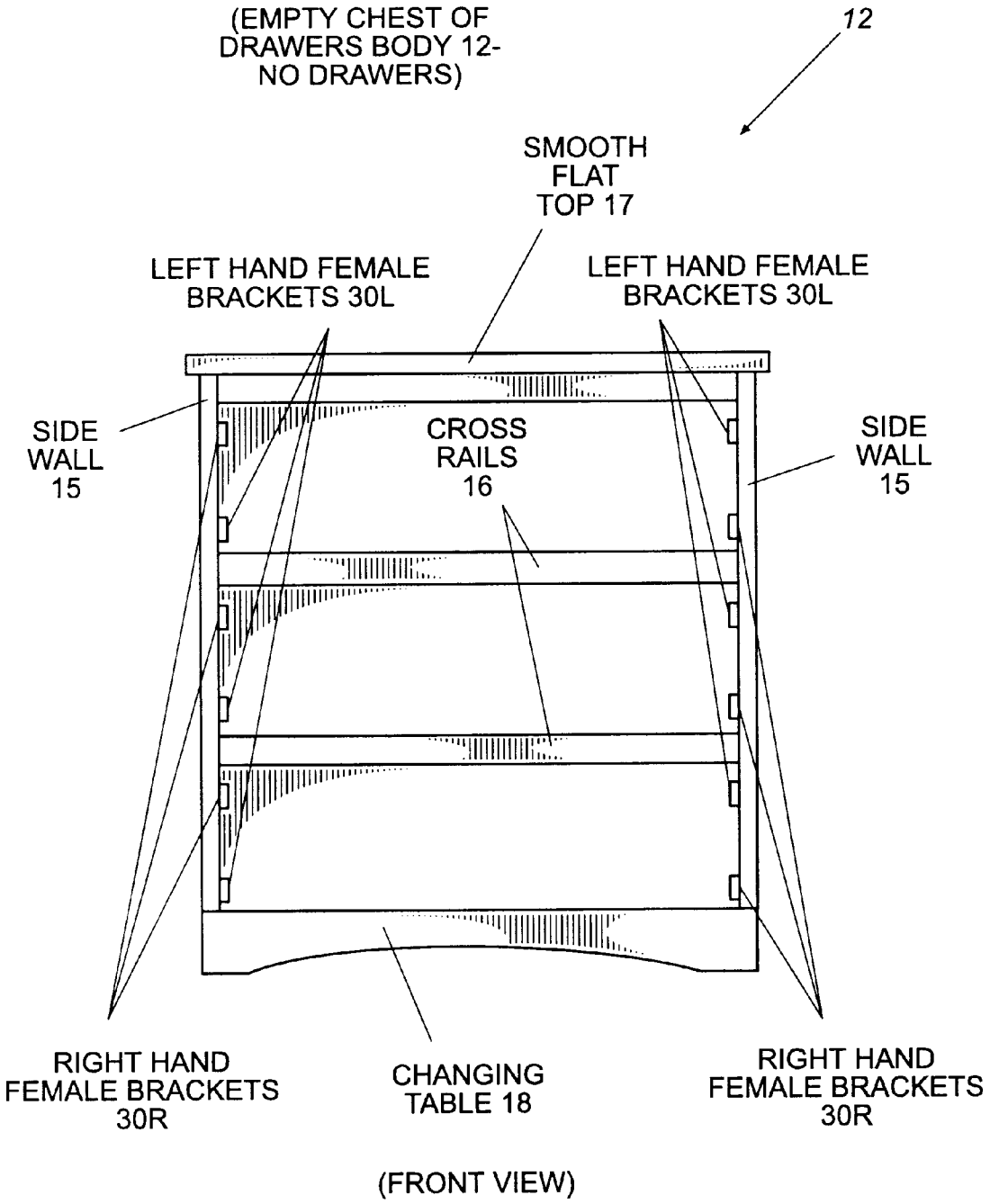
FIG. 1 is a front elevational view of an chest of drawers body 12 with no drawers shown in place. The orientation of the chest of drawers body 12 is such that its flat "top" is facing upwardly.

Referring now to FIG. 1, an empty chest of drawers body 12 is illustrated, which does not include the drawer assemblies 20 but does include the female brackets 30.

The chest of drawers body 12 includes a pair of side walls 15, an upper top member 17 (defining a flat surface), and various horizontal cross or "rail" members 16. At the bottom of the chest of drawers body 12 may be understood to be a "changing table" configuration 18, in that it defines a cavity defined by a floor and peripheral side walls, configured to accept and to some extent contain an infant being placed upon a mattress therein. Changing table configurations in and of themselves are well known in the art.

The Drawers 20

FIG. 2 illustrates a drawer assembly 20 located within one of the three cavities defined by the empty chest of drawers body 12 of FIG. 1. Generally described, each of the drawer assemblies 20 includes a horizontal base panel, and four upstanding wall panels extending from the peripheral edges of the horizontal base panel. The drawer assemblies are configured to contain items such as clothing by placement atop the horizontal base panel and within the four upstanding wall panels.

In FIG. 2, the "face" or front wall panel of a drawer assembly 20 is removed, to generally illustrate the interaction of left and right hand male bracket members 40L, 40R, as they interact in the configuration shown in FIG. 2 with corresponding left and right hand female bracket members 30L, 30R.

The Brackets

Generally described, the bracket members, when used in the inventive configuration, allow for the drawer assemblies 20 to be easily used in either of the two configurations shown in FIGS. 3 and 4, while providing for ready no-tools conversion between the two configurations.

Example brackets are shown best in FIGS. 5–8. Reference is first made to Fig: 5, which is an isolated left side elevational side view of a left hand female bracket 30L according to the present invention, having a stationary roller 36 rotatably mounted therein along an axis which is fixed relative to the frame of the chest of drawer assembly 10 when in typical use. This view is a view which faces a sidewardly-directed "channel" defined by the left hand female bracket 30L. This channel is defined by upper and lower shelves 34, 35, and extends substantially along the length of the left hand female bracket 30L. At the front of the left hand female bracket 30L is a stationary roller, mounted on the same side as the channel faces. This stationary roller 36 is rotatably mounted to the left hand female bracket 30L about an axis which is substantially horizontal when the bracket is mounted in place. This stationary roller 36 is configured to engage and support a downwardly-oriented shelf of a corresponding left hand male bracket, shown in FIGS. 7 and 8 and discussed in detail later.

Figure 5:
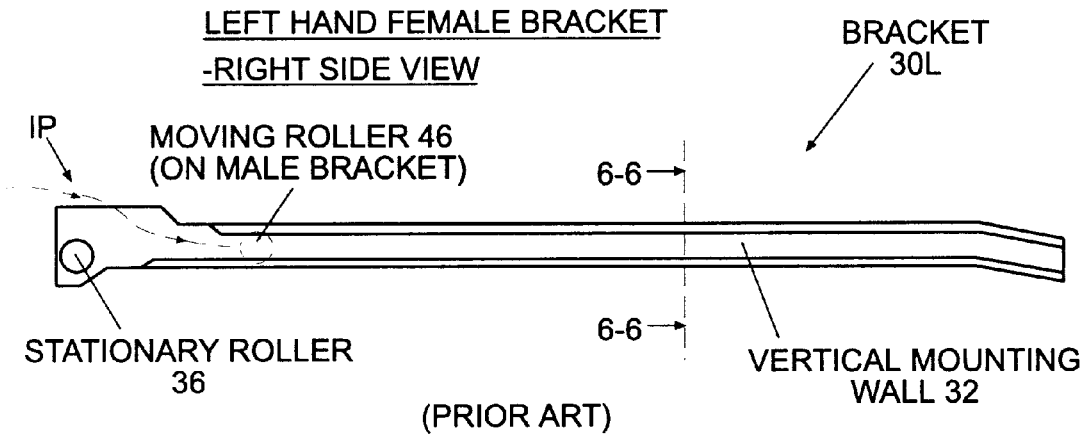
(PRIOR ART) Fig. 5
FIG. 5 is an isolated left side elevational side view of a left hand female bracket 30L according to the present invention, having a stationary roller 36 rotatably mounted therein along a horizontal axis which is fixed relative to the frame of the chest of drawer assembly 10 when in typical use. A "moving roller" 46, part of another bracket, is shown in phantom.
Figure 6:
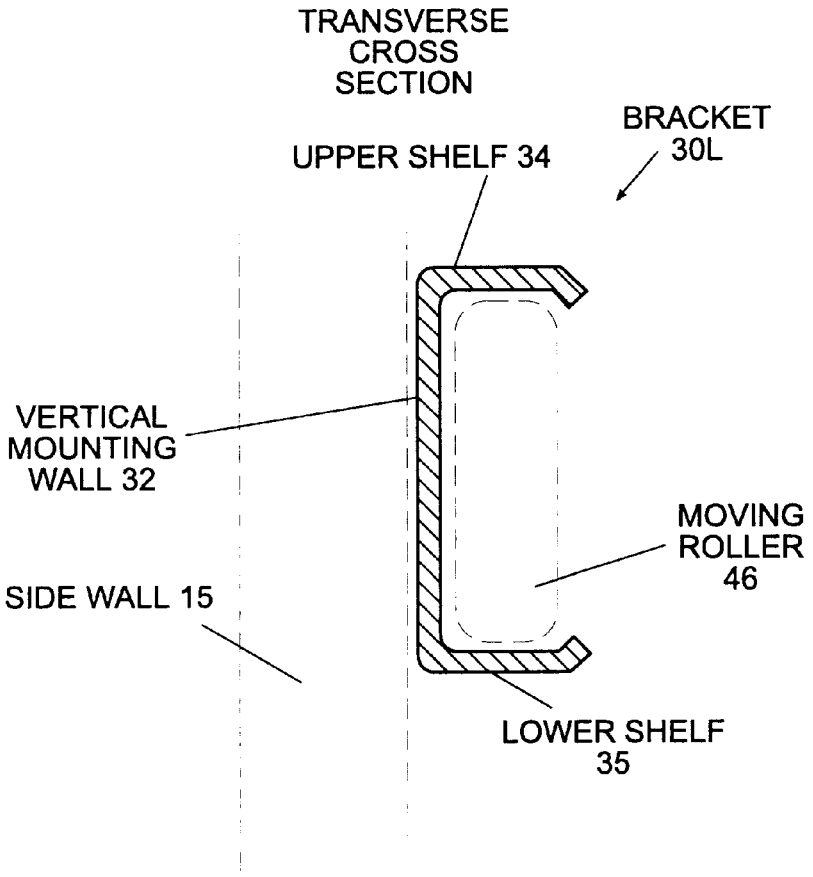
FIG. 6 is a cross sectional view of the left hand female bracket 30L of FIG. 5, viewed from the front, showing a downturned upper shelf 34 and an upturned lower shelf 35, with a moving roller 46 from an unshown mating male bracket shown in phantom and as being captured by the upper and lower shelves 34, 35. A side wall 15 of the chest of drawers body 12 is also shown in phantom.

FIG. 6 is a cross sectional view of the bracket 30L of FIG. 5, viewed from the front, showing a downturned upper shelf 34 and an upturned lower shelf 35, with a moving roller 46 from an unshown mating male bracket shown in phantom and as being captured by the two shelves 34, 35. A side wall 15 of the chest of drawers body 12 is also shown in phantom.

Figure 7:
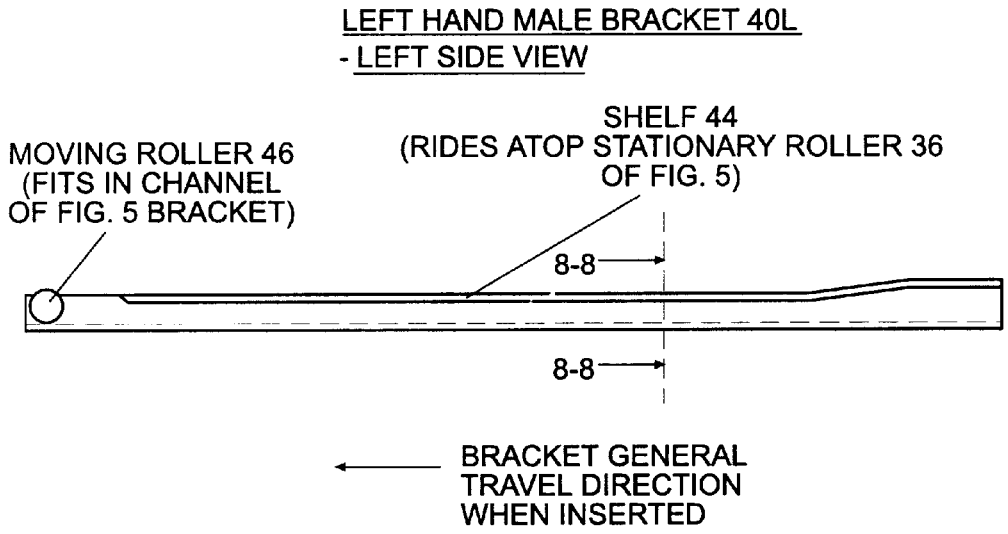
Fig. 7 (PRIOR ART)
FIG. 7 is an isolated left side elevational view of a left hand male bracket 40L, which includes a downturned shelf 43, which faces away from the viewer as FIG. 7 is drawn.
Figure 8:
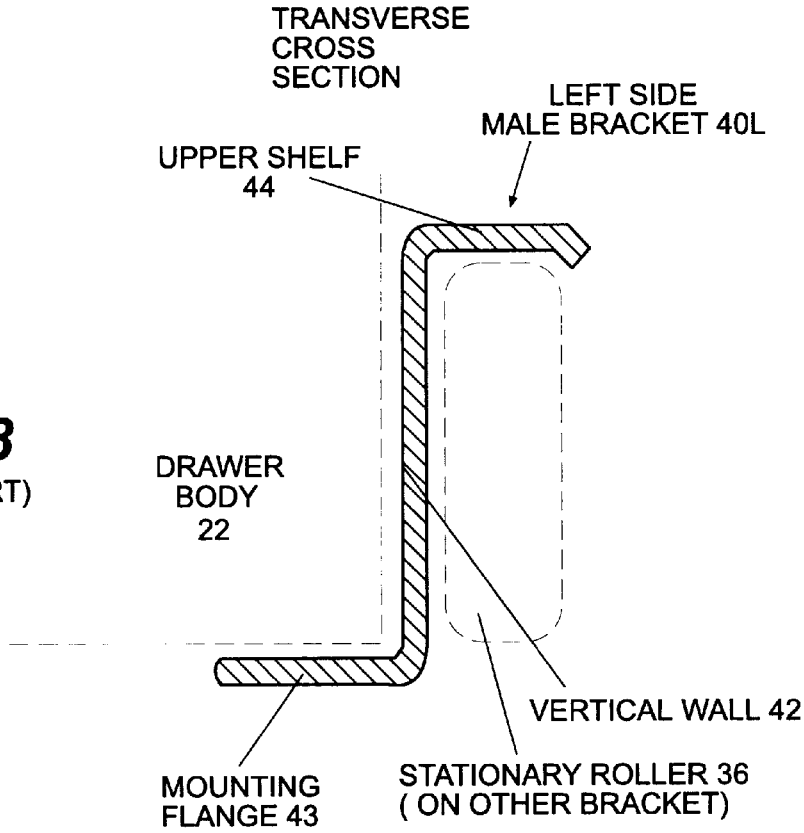
Fig. 8 (PRIOR ART)
FIG. 8 is a cross sectional view of the bracket of FIG. 7, viewed from the rear, with a corner of a drawer body 22 shown in phantom.

FIG. 7 is an isolated left side elevational view of a left hand male bracket 40L. FIG. 8 is a cross sectional view of the bracket of FIG. 7, viewed from the rear, with a corner of a drawer body 22 shown in phantom. This left hand male bracket 40L includes a downturned shelf 43, which faces away from the viewer as FIG. 7 is drawn. The left hand male bracket 40L also defines a downturned shelf 44.

It should also be understood that there are is a corresponding right hand female bracket 30R used under the present invention, which is a mirror image of left hand female bracket 30L shown in FIG. 5. Likewise, there is a corresponding right hand male bracket 40R which is a mirror image of the bracket 40L shown in FIG. 7.

When installed, as shown in FIG. 2 a pair of "male" brackets 40L, 40R, are attached to the bottom corners of each drawer assembly 20. Only two male brackets (left hand 40L and right hand 40R) are attached to each drawer assembly 20, at the bottom comers.

Also as shown in FIG. 2 and also in FIG. 1, two pairs of female bracket members (each pair including a left hand bracket 40L and a right hand bracket 40R) are located within each drawer cavity 14 of the chest of drawers body 12. As will be seen by further discussion, only one bracket pair is engaged with the corresponding male brackets at a time.

As shown in FIG. 2 the "upright" left and right hand female bracket members are engaged with the left and right hand male bracket members when the chest of drawers body 12 is in its "upright" configuration. However, it may be readily understood that if the chest of drawers body 12 is inverted, the "inverted" left and right hand female bracket members will then be in a position to engage the left and right hand male members in a similar manner.

Interaction of the Brackets

When engaged, the stationary roller of the left hand female bracket 30F fits under the shelf 44 of the left hand male bracket 40L (see FIG. 8), and the moving roller 46 of the left hand male bracket 40L fits within the channel of the left hand female bracket (see FIG. 6). The shelf 44 of the left side male bracket rests atop the stationary roller, and is supported thereby. Therefore, four locations are provided to provide support for each drawer 20 as it is placed within the cavity, and slid therein.

Assembly of the Upright Configuration

Installation of a drawer 20 shelf and its subsequent reversal within the body 12 is as follows. The drawer 20 is situated adjacent the chest of drawers 10 with its rear wall substantially adjacent to its associated receiving cavity. However, the rear edge of the drawer is raised slightly somewhat. The rollers 46 on the leading edge of the brackets 40 are then each simultaneously guided into place by guiding them into the insertion point IP such as shown in FIG. 5. At this point, the drawer 20 can then be pivoted to its horizontal position as the drawer is pushed into place. It may be understood that as such horizontal position is obtained, the downwardly-directed shelf 44 of the male brackets 40 are lowered into contact with the stationary rollers 36 of the brackets 30.

FIG. 3 illustrates a completed chest of drawers 10 assembly according to the present invention in its "upright" position. As may be seen, the drawers 20 are their "upright" configuration, located within the chest of drawers body 12, which is likewise in its "upright" configuration.

FIG. 4 illustrates a chest of drawers 10 according to the present invention in its "inverted" configuration. As may be seen, the chest of drawers body 12 is inverted, while the drawers 20 remain in their "upright" configuration. This is because the drawers have been removed, and inverted to allow them to be replaced within the respective cavities after the chest of drawers body 12 has been inverted.

Operation

Operation of the drawers after insertion is conventional.

Alternate Configurations

It may be understood that the drawers 20 illustrated may all be substantially identical in configuration, which would allow them to be placed within whatever drawer cavity so pleases the user. However, it should also be understood that the cavities and drawers could have different sizes, although preferably they should be rectangular. In such a configuration, it might be necessary for a particular drawer to be removed, inverted, and replaced into the same drawer cavity. It should also be understood that other configurations could also include one or more doors. In such configurations, the doors would typically open in the opposite direction when the body is inverted.

It should also be understood that the male and female brackets could be reversed; for example, one female bracket could be used in conjunction with two male brackets. Instead of four brackets mounted within one drawer cavity being associated with two brackets attached to a corresponding drawer, four brackets could be attached to the drawer, and two brackets mounted within a corresponding drawer cavity.

Advantages

Figure 9:
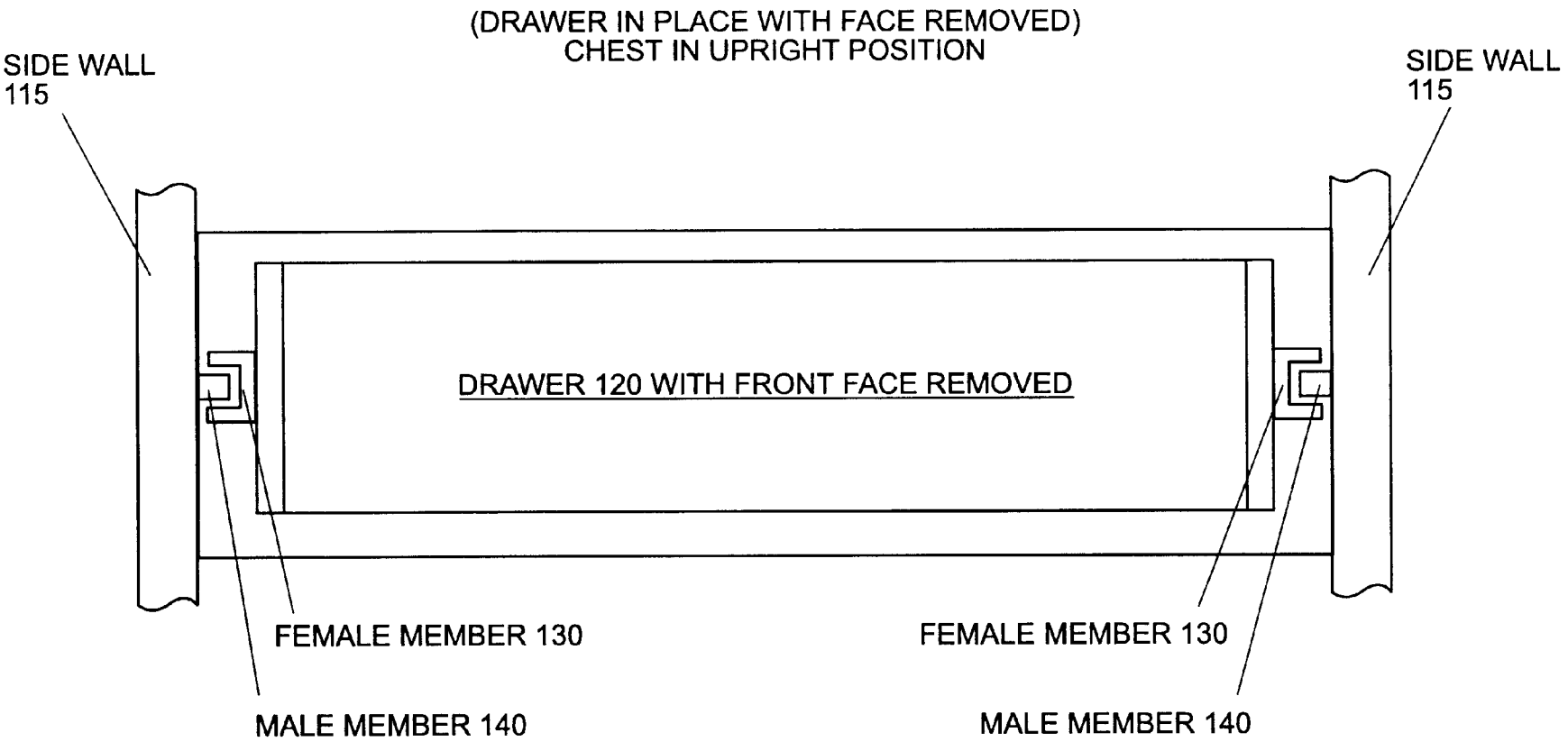
Fig .9 (PRIOR ART)
FIG. 9 is an illustration of a prior art reversible drawer configuration. A reversible drawer assembly 120 is reversible due to interaction of two channel-type female members 130, attached to each side of the drawer 120, which accept corresponding stationary elongate male members 140 for sliding engagement therewith. A side wall 115 supports each male member 140. The side walls 115 are part of an overall chest of drawer's body which can be inverted with the reversible drawers 120 removed, such the reversible drawers may be inserted in their "upright" configuration regardless of which of the two positions the chest of drawers' body may take.

A prior art configuration is shown in FIG. 9, which shows a prior art drawer 120 having two prior art female channel members 130 attached thereto, one to each side wall. These two elongate channel members 130, having their corresponding channels in mutual side opposition, are configured to frictionally engage two corresponding elongate male members 140, which are attached to the side walls 115 of a prior art reversible chest of drawers apparatus. As may be understood, the male members 140 frictionally engage the female members 130 to allow for sliding engagement therebetween. As may be understood, such frictional sliding is disadvantageous from both a wear and an operability standpoint; such configurations tend to bind and stick, especially with age. The drawers can also be difficult to use by small children, especially when heavily loaded with contents such as clothes.

Therefore it may be seen that the present invention provides an improvement over the known prior art by providing a chest of drawers configuration which includes drawers which are removable and reversible within their respective cavities, thus providing a chest of drawers configuration with an "invertible" capability. Such a capability includes the use of a single chest of drawers configurable in either a "flat top" traditional configuration, or alternately in an inverted "changing table" configuration.

Conclusion

While this invention has been described in specific detail with reference to the disclosed embodiments, it will be understood that many variations and modifications may be effected within the spirit and scope of the invention as described in the appended claims.

What is claimed is:

1. A furniture apparatus convertible from a smooth-topped chest of drawers to a changing table configuration, said apparatus comprising:

a chest of drawers body frame, said frame defining a smooth-topped end and a changing-table end opposite said smooth-topped end, said frame including at least two side walls disposed between said smooth-topped end and said changing-table end, and said frame defining at least one drawer cavity defined between said side walls;

first drawer engagement means mounted to at least one side wall of said frame and within said drawer cavity;

second drawer engagement means mounted to at least one side wall of said frame and within the same said drawer cavity; and a drawer assembly including at least one wall panel and a floor defining a planar floor supporting surface, said floor supporting surface and said wall panel defining a storage cavity, said drawer assembly having frame engagement means configured to allow said drawer assembly to be inverted from:

a) a first orientation within said drawer cavity during which said first drawer engagement means engages said frame engagement means and said planar floor supporting surface is facing a first direction relative to said frame, to b) a second, inverted orientation also within said drawer cavity during which said second drawer engagement means engages said frame engagement means and said planar floor supporting surface is facing a second direction opposite to said first direction relative to said frame;

wherein said first drawer engagement means includes a first elongate channeled portion, wherein said second drawer engagement means includes a second elongate channeled portion, and wherein said frame engagement means includes a roller rotatably mounted relative to said drawer, said roller configured to be captured within said first elongate channeled portion when said drawer assembly is in said first orientation, and captured within said second elongate channeled portion when said drawer assembly is in said second, inverted, orientation; and wherein said first and second drawer engagement means within said drawer cavity include corresponding first and second stationary axis rollers, wherein said frame engagement means includes a ledge, and wherein said ledge is supported by said first stationary axis roller of said first drawer engagement means when said drawer is in place in said first orientation, and is supported by said second stationary axis roller when in said second, inverted, orientation.

2. A furniture apparatus comprising:

a drawer assembly having a predetermined drawer assembly height, said drawer assembly including at least one frame engagement means, at least one wall panel, and a floor defining a planar floor supporting surface, said floor supporting surface and said wall panel at least partially defining a storage cavity;

a chest of drawers body frame, said frame defining a first end and a second end opposite said first end, said frame including at least two side walls disposed between said first end and said second end, said frame defining at least one drawer cavity defined between said side walls, said drawer cavity having a height corresponding to said predetermined drawer assembly height such that said drawer cavity cannot receive any more drawers once said drawer assembly is in place in said drawer cavity, a first drawer engagement means mounted to one of said two side walls of said frame and within said drawer cavity; and a second drawer engagement means mounted to the other of said two side walls of said frame and within the same said drawer cavity, said drawer assembly, said body frame, and said first and second drawer engagement means being configured to cooperate to allow said drawer assembly to be inverted from:

a) a first orientation within said drawer cavity during which said frame engagement means engages said first drawer engagement means, said frame engagement means does not engage said second drawer engagement means, and said planar floor supporting surface is facing a first direction relative to said frame, to b) a second, inverted orientation also within said drawer cavity during which said frame engagement means engages said second drawer engagement means, said frame engagement means does not engage said first drawer engagement means, and said planar floor supporting surface is facing a second direction opposite to said first direction relative to said frame.

3. The furniture apparatus as claimed in claim 2, wherein a vertical position of said drawer assembly relative to said frame when said drawer assembly is in said first orientation is about the same as a vertical position of said drawer relative to said frame when said drawer is in said second, inverted orientation.

4. A furniture apparatus comprising:

a chest of drawers body frame, said frame defining a first end, a second end opposite said first end, and said frame including at least a first and a second side wall disposed between said first end and said second end, said frame defining at least one drawer cavity defined between said first and second side walls;

a right-hand-only drawer engagement member mounted within said drawer cavity to said first side wall in an upright position;

a left-hand-only drawer engagement member mounted within said drawer cavity to said first side wall in an inverted position;

a drawer assembly including at least one wall panel and a floor defining a planar floor supporting surface, said floor supporting surface and said wall panel defining a storage cavity, said drawer assembly having frame engagement means configured to allow said drawer assembly to be inverted from:

a) a first orientation within said drawer cavity during which said frame engagement means engages said right-hand-only drawer engagement member and said frame engagement means does not engage said left-hand-only drawer engagement member, and said planar floor supporting surface is facing a first direction relative to said frame, to b) a second, inverted orientation also within said drawer cavity during which said frame engagement means engages said left-hand-only drawer engagement member and said frame engagement means does not engage said right-hand-only drawer engagement member, and said planar floor supporting surface is facing a second direction opposite to said first direction relative to said frame.

5. The furniture apparatus as claimed in claim 4, wherein said right-hand-only drawer engagement member is a first right-hand-only drawer engagement member and said left-hand-only drawer engagement member is a first left-hand-only drawer engagement member, and further comprising:

a second left-hand-only drawer engagement member mounted within said drawer cavity to said second side wall in an upright position; and a second right-hand-only drawer engagement member mounted within said drawer cavity to said second side wall in an inverted position, wherein when said drawer assembly is in said first orientation within said drawer cavity, said second left-hand-only drawer engagement member engages said frame engagement means and said second right-hand-only drawer engagement member does not engage said frame engagement means, and wherein when said drawer assembly is in said second, inverted, orientation within said drawer cavity, said second right-hand-only drawer engagement member engages said frame engagement means and said second left-hand-only drawer engagement member does not engage said frame engagement means.

* * * * *